US005419843A

United States Patent [19]

Wu et al.

[11] Patent Number: 5,419,843

[45] Date of Patent: May 30, 1995

[54] FABRIC CONDITIONERS DERIVED FROM PYRIDINE CARBOXYLIC ACIDS

[75] Inventors: Shang-Ren Wu, Mahway; Eddie N. Gutierrez, Midland Park, both of N.J.

[73] Assignee: Lever Brothers Company, Division of Conopco, Inc., New York, N.Y.

[21] Appl. No.: 262,074

[22] Filed: Jun. 16, 1994

[51] Int. Cl.[6] ..... D06M 13/322; D06M 13/46

[52] U.S. Cl. ..... 252/88; 252/8.6; 546/315; 546/347; 427/384

[58] Field of Search ..... 252/8.6, 8.8; 546/315, 546/347; 427/384; 8/115.51

[56] References Cited

U.S. PATENT DOCUMENTS

| | | | |
|---|---|---|---|
| 4,137,180 | 1/1979 | Naik et al. | 252/8.8 |
| 4,631,339 | 12/1986 | Wheeler | 540/492 |
| 4,767,547 | 8/1988 | Straathof et al. | 252/8.8 |
| 4,789,491 | 12/1988 | Chang et al. | 252/8.75 |
| 4,913,828 | 4/1990 | Caswell et al. | 252/8.8 |
| 5,079,366 | 1/1992 | Bodor | 546/175 |
| 5,180,831 | 1/1993 | Powers et al. | 546/291 |
| 5,254,269 | 10/1993 | Taylor et al. | 252/8.6 |

OTHER PUBLICATIONS

Kozlova, N. V., "Surfactant Properties of N-(alkyloxycarbonylmethylpyridinium chlorides . . . " Chemical Abstract No CA94(20):158698j (1980) [no month].

*Primary Examiner*—Anthony Green
*Attorney, Agent, or Firm*—A. Kate Huffman

[57] ABSTRACT

Novel fabric conditioners based on pyridine carboxylic acid esters or amides are described. The compounds are effective fabric conditioners and are biodegradable. Compositions including the compounds and a method of using the compositions are also described.

9 Claims, No Drawings

FABRIC CONDITIONERS DERIVED FROM PYRIDINE CARBOXYLIC ACIDS

FIELD OF THE INVENTION

This invention relates to fabric conditioners based on pyridine carboxylic acids which are both effective fabric conditioners and which are biodegradable.

BACKGROUND OF THE INVENTION

Quaternary ammonium salts such as N,N-di(tallow-oyl-oxy-ethyl)-N,N,-dimethylammonium chloride and 1,2 ditallowyl oxy-3-trimethylammino propane chloride have been developed as described in U.S. Pat. Nos. 4,137,180; 4,767,547 and 4,789,491.

Because of softening properties and ease of processing, a preferred biodegradable quaternary ammonium salt is a diester compound of the formula described in Column 1 of U.S. Pat. No. 4,137,180.

It has been discovered, however, that many of the diester compounds described above degrade to a monoester form which in certain levels can be aquatically toxic. Moreover, when the diester compounds are processed with relatively large quantities of alcohol the obtained compounds are more likely to form monoester degradation intermediates.

Therefore, there is a need for novel molecules which are both effective fabric conditioners and which are biodegradable.

There is further a need for a fabric conditioning molecule which is formed from compounds having a natural rather than a synthetic source.

SUMMARY OF THE INVENTION

It is thus an objective of the invention to provide novel compounds which are both effective fabric conditioners and which are biodegradable.

Another objective of the invention is to provide fabric conditioning compositions containing the pyridine esters or amides of the invention which are useful in fabric softening and static control in a variety of stable physical forms.

A further object of the invention is to provide environmentally friendly fabric conditioning compositions which are effective fabric softeners.

Yet another object of the invention is to provide a process for laundering fabrics which yields effective fabric conditioning using the novel cationic molecules of the invention.

DETAILED DESCRIPTION OF PREFERRED EMBODIMENTS

This invention relates to compounds of Formula I

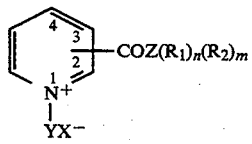

(I)

having a monosubstituted ester or amide linked moiety $—COZ(R_1)_n(R_2)_m$ wherein when Z is O or NH, n is 0, m is 1 and $R_2$ is a straight or branched $C_{16.50}$ alkyl, alkenyl or alkoxy and when Z is N, n is 1, m is 1, and $R_1$ and $R_2$ are each a straight or branched alkyl, alkenyl or alkoxy and $R_1$ and $R_2$ together have a total 16–50 carbons, and the monosubstituted moiety may be at the 2, 3, or 4 position on the pyridine ring, Y is a $C_{1-3}$ alkyl and $X^-$ is a water soluble anion.

The term "water soluble" means that the cationic compounds of Formula I remain dispersed throughout the laundry solution during the washing process.

Preferred compounds of Formula Iinclude those wherein when Z is 0 or NH, $R_2$ is a straight or branched $C_{24-40}$ alkyl and when Z is N, $R_1$ and $R_2$ are each a $C_{16-25}$ alkyl.

The anion $X^-$ is preferably the anion of a strong acid such as, for example, chloride, bromide, iodide, sulfate and methyl sulfate. The anion may carry a double charge in which case $X^-$ represents half a group.

Preferred compounds of Formula Iinclude salts of a $C_{24-50}$ alkyl ester of N-methyl 3-carboxypyridinium, $C_{24-50}$ alkyl ester of N-methyl 2-carboxypyridinium, and $C_{24-50}$ alkyl ester of N-methyl 4-carboxypyridium; and N-methyl N,N dioctadecyl, 3-carboxamide pyridinium and N-methyl N,N dioctadecyl, 4-carboxamide pyridinium.

Preparation

The compounds of the invention are prepared from pyridine and quaternary sources which are naturally occurring and not synthetically produced. Upon degradation, these compounds are reduced to their natural sources to form environmentally friendly compounds.

Pyridine carboxylic acid chloride HCI salt is added to an alkanol or dialkyl amine in a suitable solvent, such as methylene chloride, toluene and xylene, and the mixture allowed to react at 0° to 160° C. for 10–24 hours. The mixture is treated with sodium carbonate solution, and the isolated pyridine ester or amide is reacted with a methylating agent such as dimethyl sulfate or methyl halide. Optionally, a base such as pyridine may be added to neutralize the HCI salt. The products may be isolated as waxy materials.

Useful alkanols include straight or branched chains up to $C_{50}$ such as dodecanol, octadecanol, and $C_{24-28}$ primary branched alcohols known as Guerbet alcohols. Long chain amines which can be used include dihexadecyl amine having up to two $C_{32}$ chains, and mixtures of chains. Long chain esters such as $N(CH_2CH_2OCO_2C_{17}H_{35})_2$ are also possible.

Fabric Conditioning Compositions

The novel compounds may be formulated in a variety of physical forms to form a fabric conditioning composition. Such a composition would comprise from about 1 to about 99 wt. % of a compound of Formula I and from about 1 to about 99 wt. % water.

Such compositions may be prepared by any conventional method known in the art.

Additional Fabric Conditioning Components

It may be understood that the compounds of the invention may be combined with conventional fabric conditioning components to form a mixture of fabric conditioning actives useful in preparing fabric conditioning compositions. Such conventional conditioning agents include acyclic quaternary ammonium salts such as ditallowdimethylammonium-methylsulfate, cyclic quaternary ammonium salts, particularly those of the imidazolinium type, diamido quaternary ammonium salts, tertiary fatty amines having at least 1 and preferably 2 $C_8$ to $C_{30}$ alkyl chains, carboxylic acids having 8 to 30 carbon atoms and one carboxylic group per molecule, esters of polyhydric alcohol such as sorbitan esters or glycerolstearate, fatty alcohols, ethoxylated fatty alcohols, ethoxylated fatty amines, mineral oils, polyols such as polyethyleneglycol, silicone oils and mixtures thereof. Suitable conventional fabric conditioning compounds are described in Taylor et al., U.S. Pat. No. 5,254,269, herein incorporated by reference.

Optional Components

Additionally, one or more optional additives may be incorporated in the fabric conditioning composition selected from the group consisting of perfumes, dyes, pigments, opacifiers, germicides, optical brighteners, fluoresers, anti-corrosion agents and preservatives. The amount of each additive in the composition is up to about 0.5% by weight.

Detergent Formulations

It has been found that the conditioning compositions of the present invention can be incorporated into both granular and liquid detergent formulations with little detrimental effect on cleaning.

The compositions are typically used at levels up to about 30% of the detergent composition, preferably from about 5 to 20% of the composition.

Detergent Surfactant

Detergent surfactant included in the detergent formulations of the invention may vary from 1% to about 98% by weight of the composition depending on the particular surfactant(s) used and the cleaning effects desired.

Preferably, the surfactant is present in an amount of from about 10 to 60% by weight of the composition. Combinations of anionic, preferably alkyl sulfates, alkyl ethoxylated sulfates, linear alkyl benzene sulfonates, and nonionic, preferably alkyl polyethoxylated alcohol surfactants are preferred for optimum cleaning, softening and antistatic performance. It may be appreciated that other classes of surfactants such as ampholytic, zwitterionic or cationic surfactants may also be used as known in the art. As generally known, granular detergents incorporate the salt forms of the surfactants while liquid detergents incorporate the acid form where stable. Examples of surfactants within the scope of the invention are described in U.S. Pat. No. 4,913,828 issued to Caswell et al., herein incorporated by reference.

Builders, accumulating agents and soil release agents known in the art may also be used in the detergent formulations. Examples of suitable such components are described in Caswell et al., U.S. Pat. No. 4,91 3,828, herein incorporated by reference.

Other Optional Detergent Ingredients

Optional ingredients for the detergent compositions of the present invention other than those discussed above include hydrotropes, solubilizing agents, suds suppressers, soil suspending agents, corrosion inhibitors, dyes, fillers, optical brighteners, germicides, pH adjusting agents, enzyme stabilizing agents, bleaches, bleach activators, perfumes and the like.

The following non-limiting examples illustrate the compounds, compositions and method of the present invention. All percentages, parts and ratios used herein are by weight unless otherwise specified.

EXAMPLES

Example 1

$C_{24}$—$C_{28}$ alkyl ester of N-methyl 3-carboxypyridinium methyl sulfate was prepared as follows.

7.2 g (0.04 mole) nicotinic acid chloride hydrochloride in 30 ml methylene chloride was reacted with 15.2 g (0.041 mole) Exxal 26 ($C_{24}$—$C_{28}$ Guerbet alcohol). The mixture was refluxed for 24 hours, then a solution of 40 g sodium carbonate in 180 ml water was added and the mixture shaken in a separatory funnel. The layers were separated and the methylene chloride layer was dried over $MgSO_4$. After distilling off the solvent, 17.6 g (0.036 mole) of nicotinic acid ester was obtained. This product was redissolved in 30–40 ml methylene chloride and 4.6 g (0.036 mole) of dimethyl sulfate was added. The mixture was fluxed for 16 hours, 300 ml methylene chloride added and the solution extracted with water to remove impurities. 21.1 g of $C_{24}$—$C_{28}$ alkyl ester of N-methyl 3-carboxypyridinium methyl sulfate was obtained.

Example 2

N-methyl, N,N dioctadecyl, 3-carboxamide pyridinium methyl sulfate was prepared as follows:

17.8 g (0.1 mole) of nicotinic acid chloride hydrochloride in 200 ml toluene was added to 54.7 g (0.105 mole) dioctadecyl amine and 30 g pyridine. The solution was stirred at 50° C. for 30 hours, was cooled and filtered, to remove insolubles. The toluene solution was evaporated on a roto evaporator and the residue was dissolved in methylene chloride. The solution was allowed to sit and insolubles were filtered. The methylene chloride flitrate was evaporated to a liquid to afford 44 g (0.07 mole) N,N dioctadecyl 3-carboxy pyridine. This product was dissolved in 150 ml methylene chloride and reacted with 9.4 g (0.075 mole) dimethyl sulfate for 24 hours. The solution was extracted with water to remove impurities and the methylene chloride layer was evaporated to afford 54.9 g of waxy N-methyl, N,N dioctadecyl, 3-carboxamide pyridinium methyl sulfate.

Example 3

Compounds of Examples 1 and 2 are used to prepare fabric conditioning formulations as follows. Sample A contains 50% by weight of the compound of Example 1. The compound is heated to 60° C. to form a premelt which is then added to water of 60° C. under stirring to form a dispersion. A salt solution as necessary to obtain a desired viscosity is also added. Sample B containing 30% of the compound of Example 2 is prepared as described above.

Example 4

To test softening performance, two grams of each of Sample A and B are separately added to one liter of tap water of ambient temperature containing 0.001% by weight of sodium alkyl benzene sulphonate to simulate the carry over of anionic detergent active from a wash. 800 ml of the obtained solution are put in a tergotometer pot and four pieces of terry towel (40 g total weight) are added. The cloths are treated for 5 minutes at 60 rpm, spun dried and line dried. The dried fabrics are assessed for softeners by an expert panel. As a control, Sample C is prepared as described in Example 3 and contains 40% by weight 1,2 ditallow oxy trimethyl ammonium propane chloride.

We claim:

1. A method of conditioning fabrics comprising contacting the fabrics with a composition having 1 to 99 wt % of a compound of Formula (I)

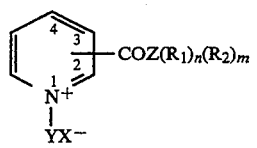

(I)

wherein —$COZ(R_1)_n(R_2)_m$ is a monosubstituted ester or amide linked moiety which may be at the 2, 3, or 4 position on the pyridine ring;

wherein Z is O, NH, or N; Y is a $C_{1-3}$ alkyl; X is a water soluble anion; $R_1$ and $R_2$ are each a straight or branched alkyl, alkenyl or alkoxy and $R_1$ and $R_2$ together have a total of 16–50 carbons; n is 0 or 1 and m is 1; with the proviso that when Z is O or NH, n is 0, m is 1 and $R_2$ is a straight or branched $C_{16-50}$ alkyl, alkenyl or alkoxy; and when Z is N, n is 1, m is 1, and $R_1$ and $R_2$ are each a straight or branched alkyl, alkenyl or alkoxy and $R_1$ and $R_2$ together have a total of 16–50 carbons; and 99 to 1 wt % water to condition the fabrics during a laundering process.

2. The method of claim 1 wherein when Z is O or NH, $R_2$ is a straight or branched $C_{24-40}$ alkyl and when Z is N, $R_1$ and $R_2$ are each a $C_{16-25}$ alkyl.

3. The method of claim 1 wherein the monosubstituted moiety is positioned on the 2 position of the pyridine ring.

4. The method of claim 1 wherein the monosubstituted moiety is positioned on the 3 position of the pyridine ring.

5. The method of claim 1 wherein $X^{31}$ is selected from the group consisting of a halide, a sulfate and a nitrate.

6. The method of claim 5 wherein $X^{31}$ is selected from the group consisting of a chloride, bromide, an iodide, and a sulfate.

7. The method of claim 5 or 6 wherein said sulfate is methyl sulfate.

8. The method of claim 1 wherein said compound of Formula (I) is selected from the group consisting of a salt of a $C_{24-50}$ alkyl ester of N-methyl 3-carboxypyridinium and a salt of a $C_{24-50}$ ester of N-methyl 2 carboxypyridinium.

9. The method of claim 1 wherein said compound of Formula (I) is N-methyl N,N dioctadecyl, 3-carboxamide pyridinium salt.

* * * * *